US010916890B2

(12) United States Patent
Lee et al.

(10) Patent No.: US 10,916,890 B2
(45) Date of Patent: Feb. 9, 2021

(54) CONNECTOR PROVIDED WITH A MOVEABLE DETECTOR BODY

(71) Applicant: Sumitomo Wiring Systems, Ltd., Mie (JP)

(72) Inventors: Minho Lee, Seongnam-si (KR); Hideto Nakamura, Seongnam-si (KR)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/569,707

(22) Filed: Sep. 13, 2019

(65) Prior Publication Data

US 2020/0091655 A1 Mar. 19, 2020

(30) Foreign Application Priority Data

Sep. 14, 2018 (JP) ..... 2018-172195

(51) Int. Cl.
*H01R 13/641* (2006.01)
*H01R 13/502* (2006.01)
*H01R 13/627* (2006.01)

(52) U.S. Cl.
CPC ..... *H01R 13/641* (2013.01); *H01R 13/502* (2013.01); *H01R 13/6272* (2013.01)

(58) Field of Classification Search
CPC H01R 13/641; H01R 13/502; H01R 13/6272; H01R 13/62; H01R 13/629; H01R 13/6271; H01R 13/6273; H01R 13/6275
USPC ..... 439/489, 345, 350, 352, 354, 357, 358, 439/488
See application file for complete search history.

(56) References Cited

U.S. PATENT DOCUMENTS 6,514,099 B2 * 2/2003 Endo ..... H01R 13/641 439/357
6,786,747 B1 * 9/2004 Kamath ..... H01R 13/6273 439/188
9,270,055 B2 * 2/2016 Campbell ..... H01R 43/26
2007/0275589 A1 11/2007 Ohtaka et al.
2015/0111407 A1 * 4/2015 Hashimoto ..... H01R 13/639 439/352
2020/0091656 A1 * 3/2020 Lee ..... H01R 13/502
2020/0091657 A1 * 3/2020 Lee ..... H01R 13/6272

FOREIGN PATENT DOCUMENTS

JP 4977404 7/2012

* cited by examiner

*Primary Examiner* — Travis S Chambers
(74) *Attorney, Agent, or Firm* — Gerald E. Hespos; Michael J. Porco; Matthew T. Hespos

(57) ABSTRACT

A connector has a housing (10) and a detector (11) is movable in the housing (10) in a front-rear direction from a standby position to a detection position in front of the standby position when the housing (10) and a mating housing (90) are connected properly. The housing (10) includes protrusions (27) on side surfaces, and the detector (11) includes side walls (53) configured to cover the side surfaces of the housing (10). The side wall (53) includes a resilient piece (55) configured to bulge outward by interfering with the protrusion (27) in a moving process to the detection position and eliminates bulge at the detection position. The side wall (53) includes the resilient piece (55) and rearward facing surfaces (57) at positions adjacent to the resilient piece (55) via slits (54) on a side surface.

7 Claims, 17 Drawing Sheets

CONNECTOR PROVIDED WITH A MOVEABLE DETECTOR BODY

BACKGROUND

Field of the Invention

The invention relates to a connector.

Related Art

Japanese Patent No. 4977404 discloses a connector that includes a connector housing and a detector mounted in the connector housing for movement between a restricting position and an allowing position.

The connector housing includes a projection on a side surface. The detector includes a side wall for covering the side surface of the connector housing and a resiliently deforming arm on the side wall. The projection and the resiliently deforming arm hold the detector at the restricting position and the allowing position and give resistance when the detector moves between the restricting position and the allowing position. Further, the detector includes a rib-like part laterally bulging on a rear end part of the side wall of the detector at a position separated from the resiliently deforming arm. The detector can be moved from the restricting position to the allowing position with this rib-like part gripped.

In the above case, a movement of the detector from the restricting position to the allowing position can be felt by a click feeling of the projection and the resiliently deforming arm, but this click feeling is not sufficient and a worker may finish a moving operation of the detector at an intermediate position (position where the resiliently deforming arm rides on the projection) of the movement of the detector to the allowing position.

The invention was completed on the basis of the above situation and aims to provide a connector enabling a detector to be moved precisely.

SUMMARY

The invention is directed to a connector with a housing connectable to a mating housing, and a detector provided in the housing movably in a front-rear direction. The detector is allowed to move from a standby position to a detection position in front of the standby position when the housing is connected properly to the mating housing. The housing includes a protrusion on a side surface and the detector includes a side wall configured to cover the side surface of the housing. The side wall includes a resilient piece configured to bulge out by interfering with the protrusion in a moving process to the detection position but stops bulging at the detection position. A side surface of the side wall includes a rearward facing surface arranged to face rearward at a position adjacent to the resilient piece via slits formed on both sides of the resilient piece.

The invention also is directed to a connector with a housing connectable to a mating housing, and a detector movably provided in the housing. The detector can move from a standby position to a detection position in front of the standby position when the housing is connected properly to the mating housing. The housing includes a protrusion on a side surface, and the detector includes a side wall configured to cover the side surface of the housing, the side wall includes a resilient piece configured to bulge outward by interfering with the protrusion in a moving process to the detection position and eliminates bulge at the detection position. A side surface of the resilient piece includes a rearward facing surface.

The detector includes the rearward facing surface. Thus, the detector can be moved from the standby position to the detection position in front of the standby position by pressing the rearward facing surface. In the process of moving the detector to the detection position, the resilient piece bulges out by interfering with the protrusion. The bulge of the resilient piece is eliminated when the detector reaches the detection position.

The rearward facing surface is provided at least at a position near the resilient piece. Thus, fingers of a worker can press the rearward facing surface and touch the bulging resilient piece. Accordingly, a movement of the detector to the detection position can be grasped tactually and the detector can be moved precisely.

An interfering portion of the resilient piece is configured to interfere with the protrusion may be arranged apart from the protrusion in the front-rear direction when the detector is at the detection position. According to this configuration, the interfering portion and the protrusion do not have a locking function of holding the detector at the detection position Thus, a degree of freedom in the structures and arrangements of the interfering portion and the protrusion can be enhanced.

The rearward facing surface may be provided in a recessed surface that is recessed with respect to a peripheral area of the resilient piece on the side wall. According to this configuration, since the resilient piece bulges out from the recessed surface in the process of moving the detector to the detection position, the worker's fingers touching the bulging resilient piece can have a good tactile sense by covering the recessed surface. Further, there is a little concern about interference with a moving operation of the detector.

DETAILED DESCRIPTION

One embodiment is described with reference to FIGS. 1 to 17. A connector of this embodiment includes a housing 10, a detector 11 and terminal fittings 12. The housing 10 is connectable to a mating housing 90. Note that, in the following description, surfaces of the housing 10 and the mating housing 90 facing each other at the start of connection are referred to as front ends, and a vertical direction is based on FIGS. 3 to 5, 9 to 12, 14 and 15.

Figure 4:
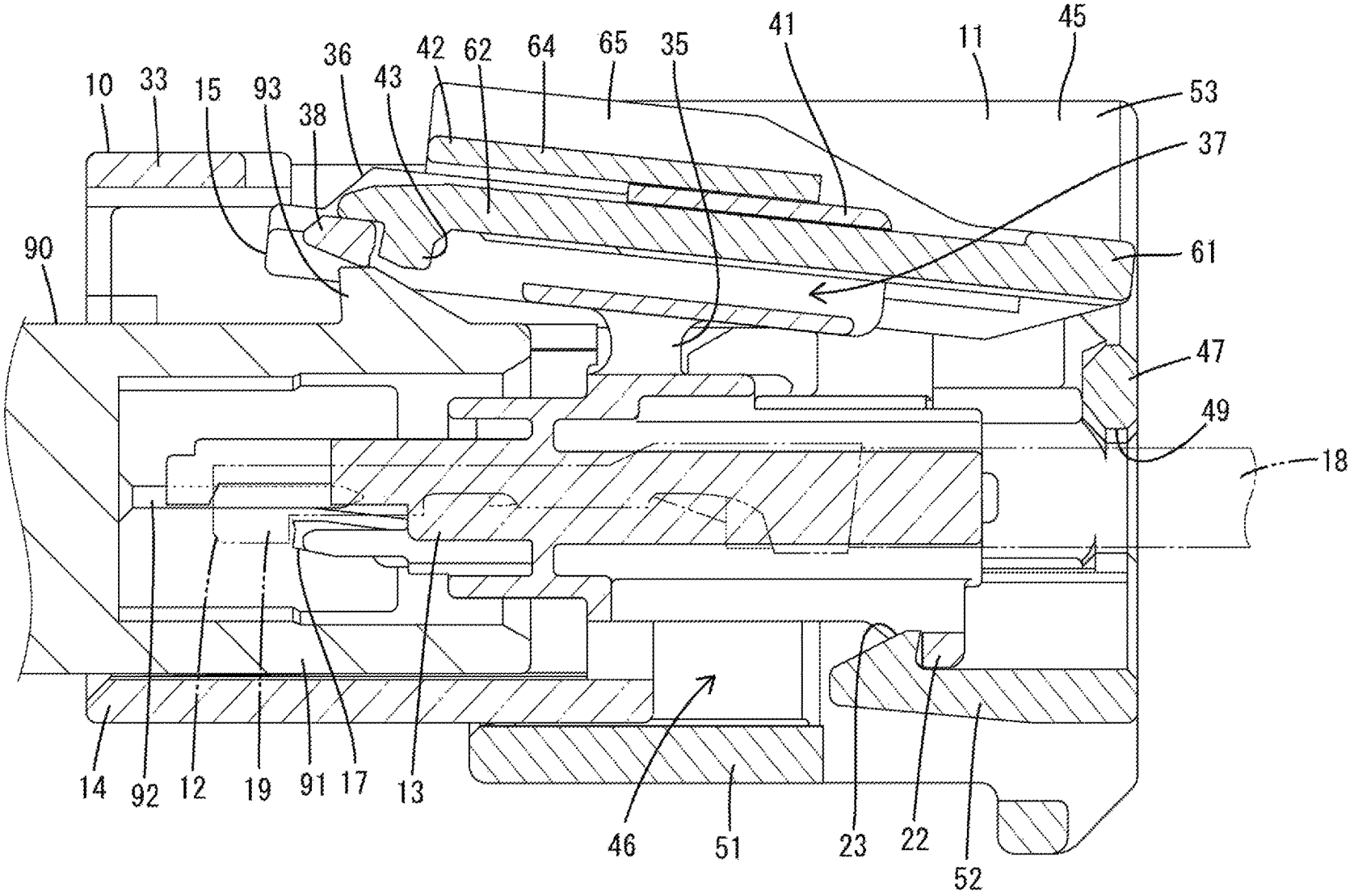
FIG. 4 is a section, corresponding to FIG. 3, showing a state while the housing is being connected to the mating housing from a state of FIG. 3.
Figure 5:
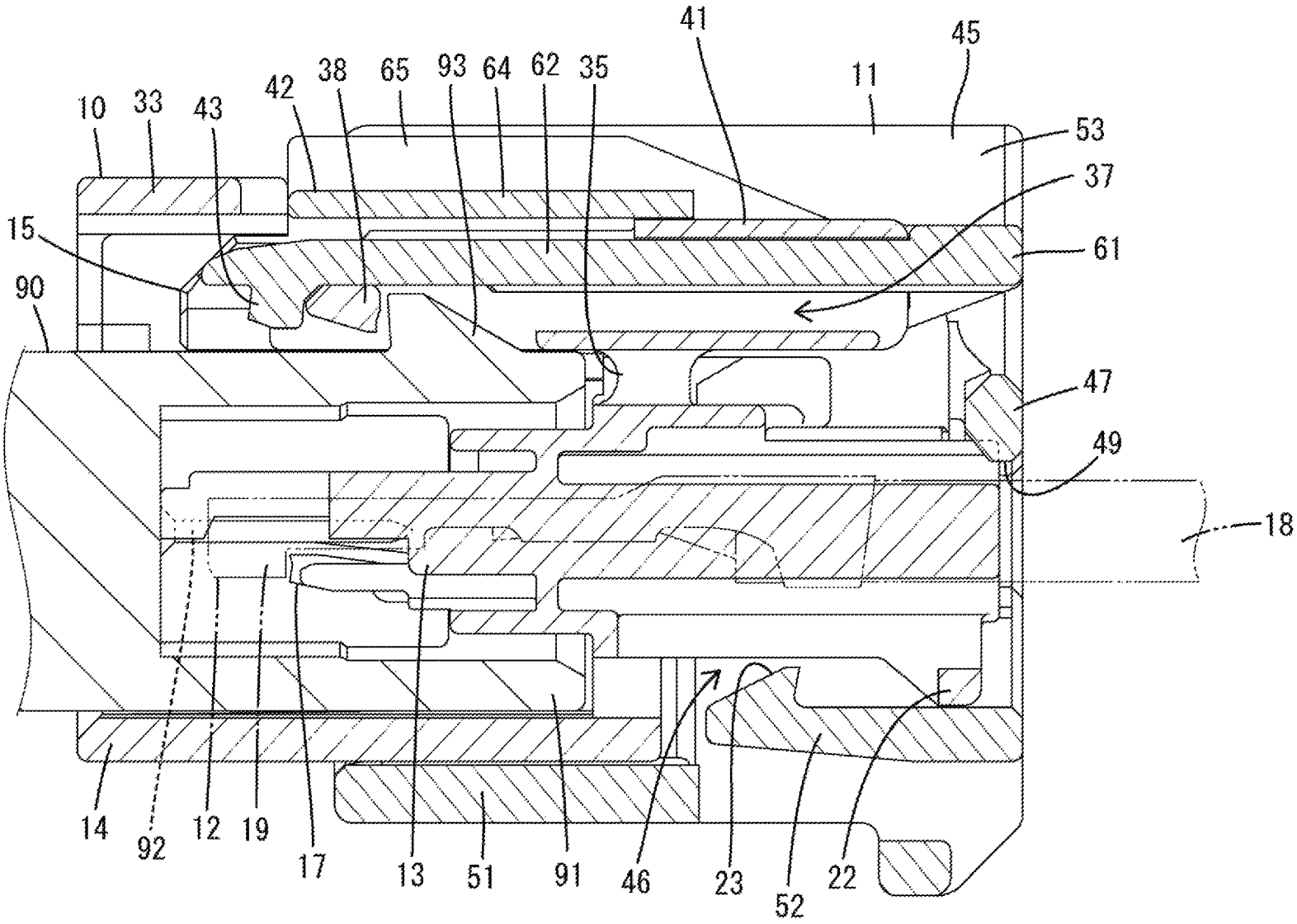
FIG. 5 is a section along B-B of FIG. 2.

The mating housing 90 is made of synthetic resin and includes, as shown in FIGS. 4 and 5, a tubular receptacle 91 directly connected to an unillustrated device and projecting forward. Tab-like mating terminal fittings 92 project into the receptacle 91. The receptacle 91 includes a claw-like projecting lock 93 on the upper surface of an upper wall.

Figure 14:
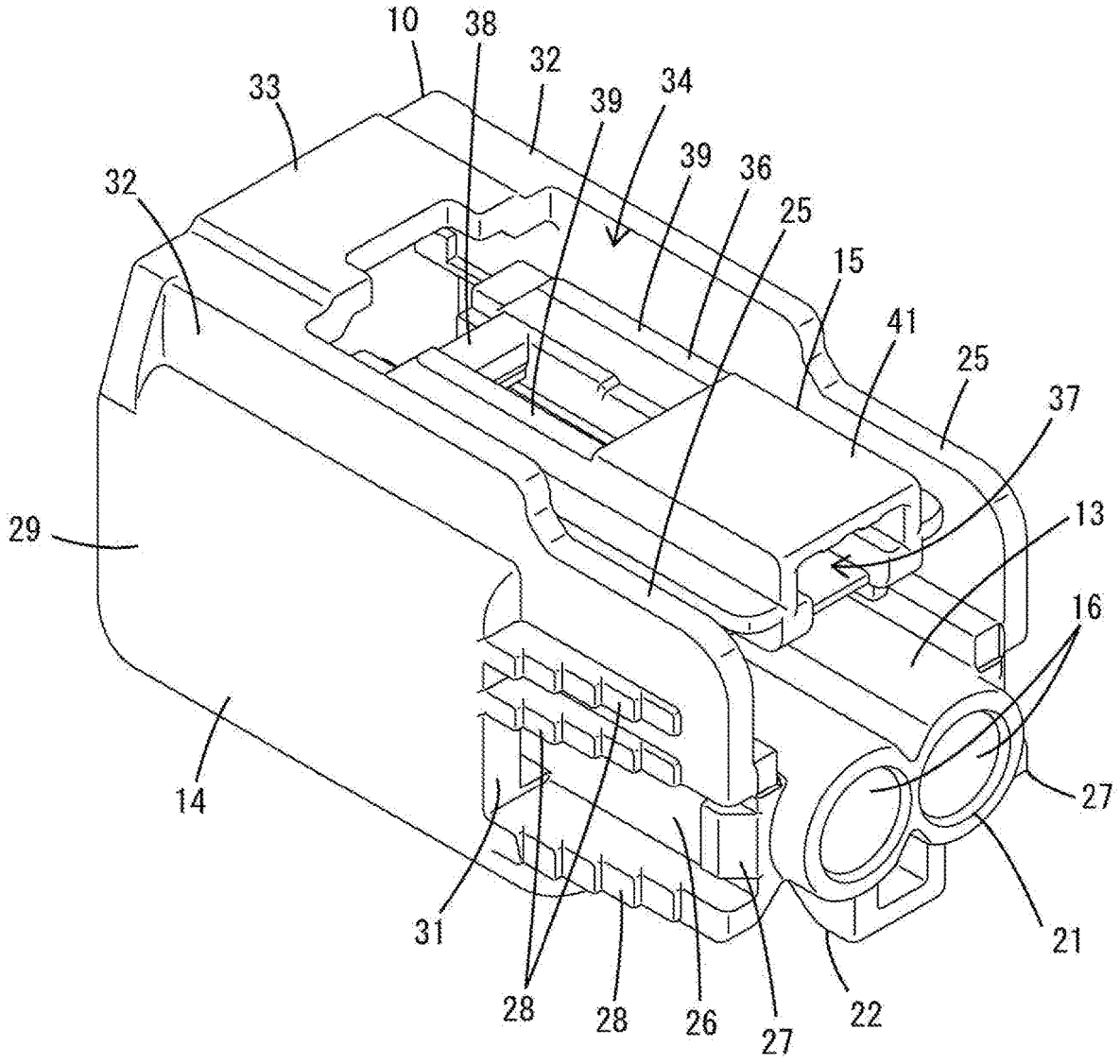
FIG. 14 is a perspective view of the housing.
Figure 15:
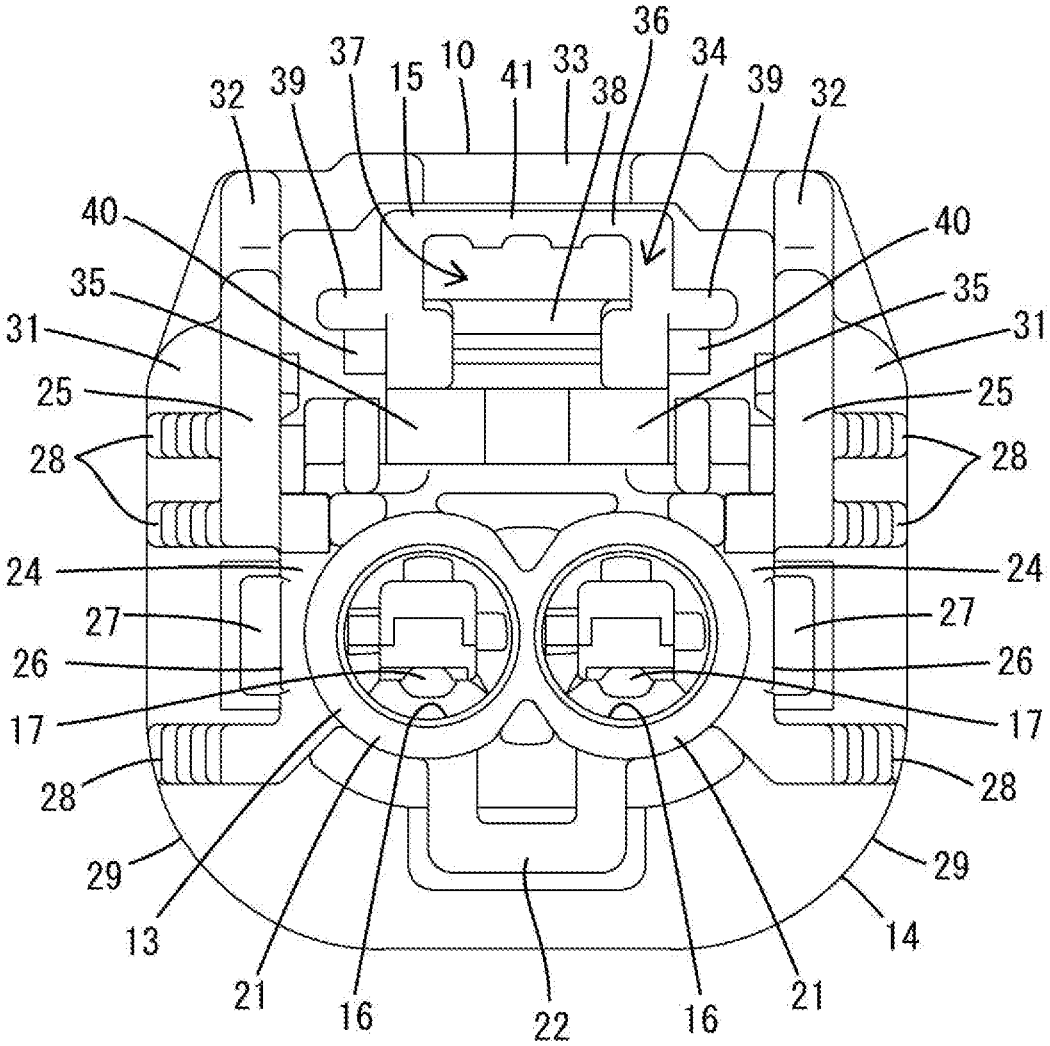
FIG. 15 is a back view of the housing.
Figure 16:
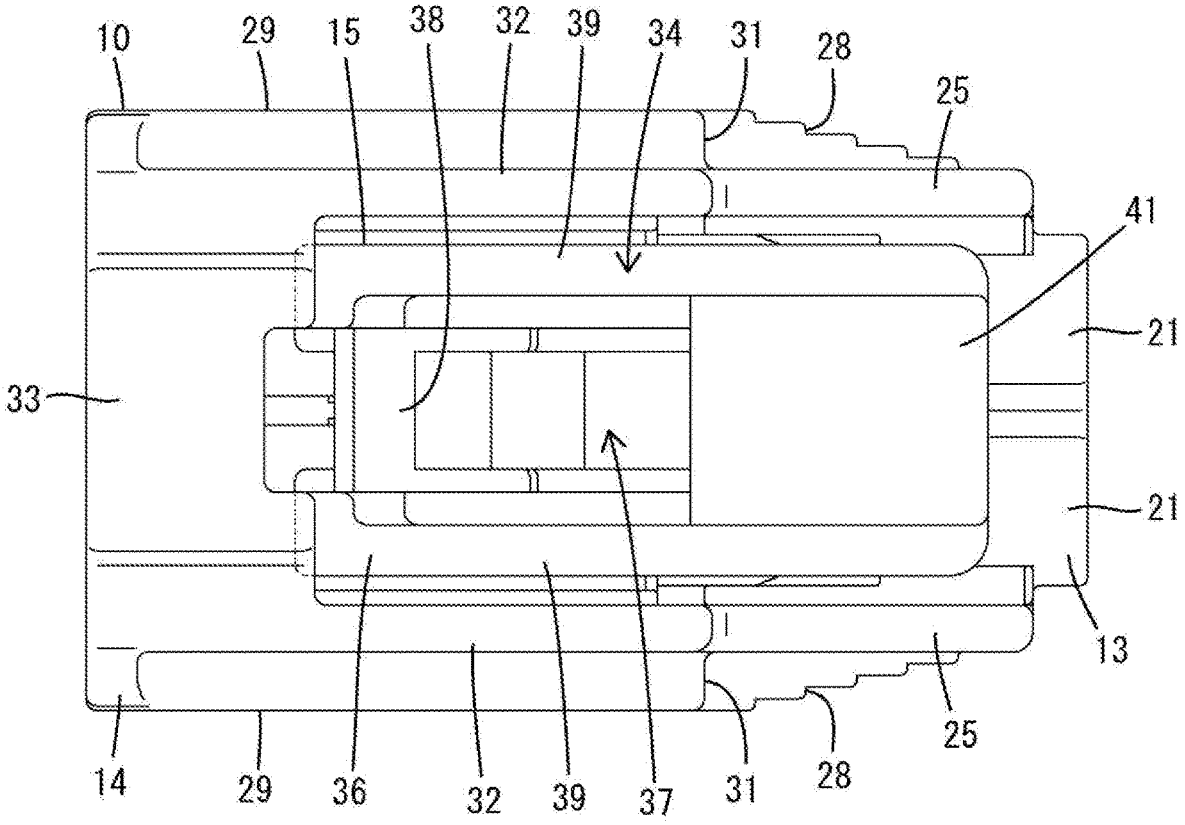
FIG. 16 is a plan view of the housing.

The housing 10 is made of synthetic resin and includes, as shown in FIGS. 14 to 16, a housing body 13, a fitting tube 14 and a lock arm 15.

Figure 6:
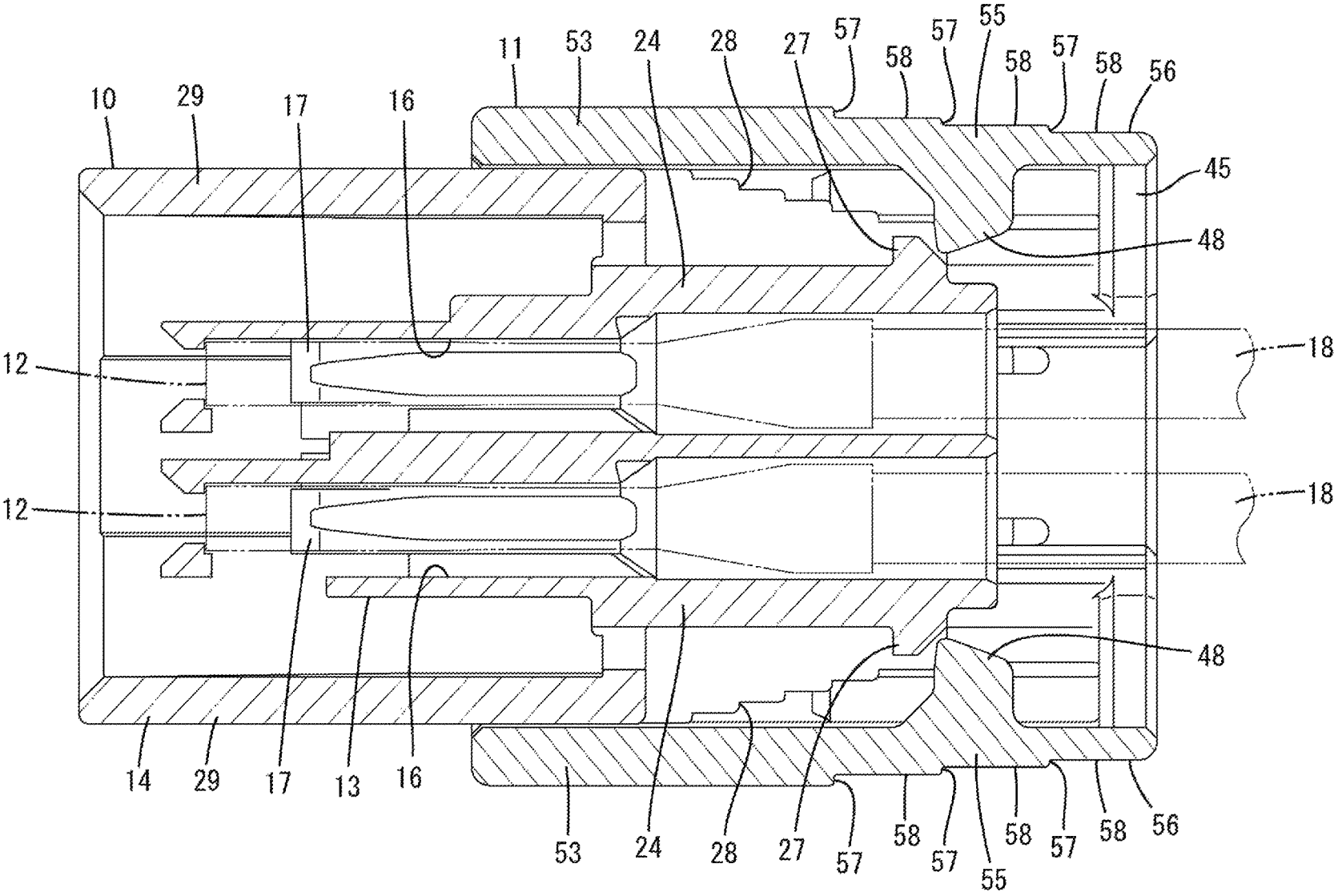
FIG. 6 is a section showing the detector held at the standby position with respect to the housing and interfering portions of resilient pieces facing protrusions of the housing.

As shown in FIG. 6, cavities 16 penetrate the housing body 13 in the front-rear direction, and a deflectable locking lance 17 projects forward at the lower surface of each cavity 16. The cavities 16 are paired in a width direction in the housing body 13 and the terminal fittings 12 are inserted therein from behind.

Each terminal fitting 12 is formed integrally such as by bending a conductive metal plate, and is connected electrically and mechanically to an end part of a wire 18. As shown in FIG. 5, the terminal fitting 12 includes a tubular connecting portion 19 into which the mating terminal fitting 92 is inserted for connection. The locking lance 17 engages the connecting portion 19 to retain terminal fitting 12 in the cavity 16.

An unillustrated front retainer is mounted in a front part of the housing body 13. The front retainer is mounted in the front part of the housing 13 to restrict deflection of the locking lances 17 for secondarily retaining the terminal fittings 12 in the cavities 16.

As shown in FIGS. 14 to 16, a rear part of the housing body 13 includes tubular portions 21 in the form of two connected cylinders defining the respective cavities 16. The wire 18 connected to each terminal fitting 12 is pulled to outside from the rear end of each tubular portion 21. An unillustrated rubber plug is fit on the wire 18 and inserted in each tubular portion 21 in a liquid-tight manner.

Figure 3:
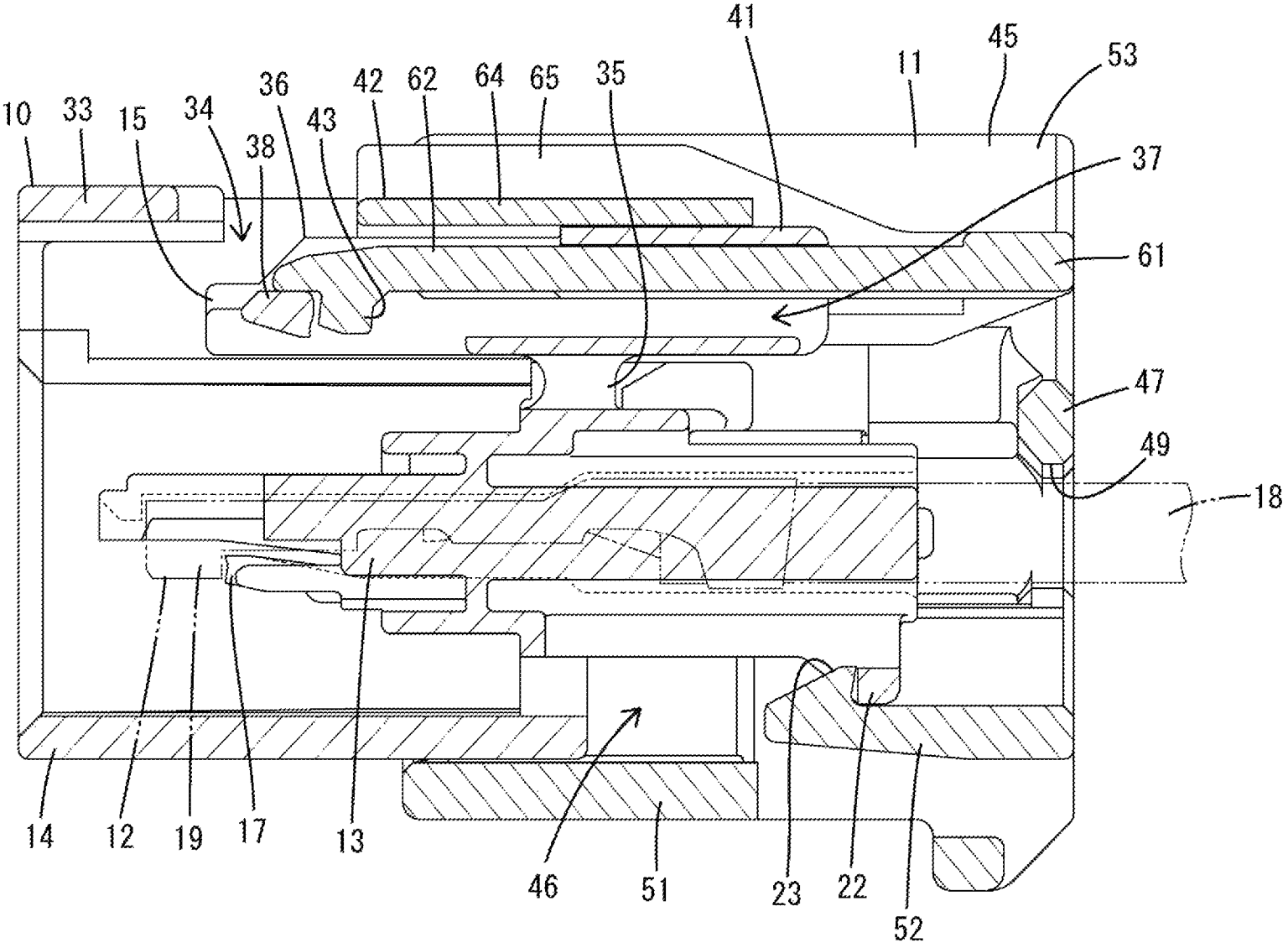
FIG. 3 is a section along A-A of FIG. 1.

As shown in FIG. 15, each tubular portion 21 includes a retaining protrusion 22 projecting down from a widthwise central part of a lower end. As shown in FIG. 3, each retaining protrusion 22 is lockable to a later-described locking claw 23 of the detector 11.

As shown in FIG. 15, the housing body 13 includes two side surfaces 24 on widthwise sides of the respective tubular portions 21, and facing walls 25 rise vertically from upper parts of the side surfaces 24. As shown in FIG. 14, each facing wall 25 is formed over substantially the entire length of the housing 10 in the front-rear direction.

As shown in FIG. 15, each side surface 24 includes a rectangular recess 26 between upper and lower parts, and a claw-like protrusion 27 is on the back surface of the recess 26. The protrusion 27 has such a projecting dimension to be confined within a depth of the recess 26. A projecting end part of the rear surface of the protrusion 27 is tapered and inclined rearward and the front surface of the protrusion 27 is arranged along the width direction.

Housing ribs 28 are formed on upper and lower parts of each side surface 24 and extend parallel to one another in the front-rear direction. Two housing ribs 28 are on the upper part and one housing rib 28 is on the lower part, and these housing ribs 28. The housing rib 28 on the lower part of each side surface 24 has a larger vertical thickness than the housing ribs 28 on the upper part and extends over the entire height of the lower part. Each housing rib 28 has a stepped shape such that a lateral projecting amount is reduced gradually toward the rear.

The fitting tube 14 surrounds the outer periphery of a front part of the housing body 13 and the receptacle 91 of the mating housing 90 is fittable between the fitting tube 14 and the front part of the housing body 13. An unillustrated seal ring is fit externally on the housing body 13 and is interposed in a liquid-tight manner between the receptacle 91 and the housing body 13 when the housings 10, 90 are connected properly.

As shown in FIGS. 15 and 16, the fitting tube 14 includes two side wall lower portions 29 covering both sides of the front part of the housing body 13. There is a step 31 between each side wall lower portion 29 and each side surface portion 24, and the front end of each housing rib 28 is integrally connected to an end surface constituting the step 31.

The fitting tube 14 includes side wall upper portions 32 rising from the upper ends of the respective side wall lower portions 29 and integrated with front parts of the facing walls 25. Further, the fitting tube 14 includes a bridge 33 spanning between the upper ends of the respective side wall upper portions 32. Open spaces 34 are formed between the facing walls 25 and the bridge 33 and are open upward and rearward.

The lock arm 15 includes legs 35 arranged between the facing walls 25. The legs 35 are paired in the width direction and rise from the upper surface of the housing body 13, as shown in FIG. 15. An arm body 36 extends forward and rearward from upper ends of the legs 35 and is exposed to the open spaces 34, as shown in FIG. 3. The arm body 36 can be tilted and displaced resiliently in a seesaw manner in the vertical direction with the legs 35 as supports.

The arm body 36 includes a rearwardly open assembly space 37 extending in the front-rear direction, as shown in FIG. 3. A housing lock 38 closes a front end of the assembly space 37, two rails 39 close both widthwise sides of the assembly space 37, as shown in FIG. 16, and a plate 41 closes a rear-upper side of the assembly space 37.

As shown in FIG. 3, a detecting body 42 of the detector 11 is inserted into the assembly space 37 of the arm body 36. The detecting body 42 has a detector locking portion 43, and the housing lock 38 is locked to a rear surface of the detector locking portion 43 facing the assembly space 37, as shown in FIG. 3, before the housings 10, 90 are connected properly. Additionally, the lock 93 of the mating housing 90 is locked to the rear surface of housing lock 38, as shown in FIG. 5 when the housings 10, 90 are connected properly. Laterally protruding parts of the respective rails 39 are inserted into rail grooves 44 of the detecting body 42 to guide the assembling of the detector 11.

Housing side locking projections 40 project on both widthwise sides of the arm body 36. Each housing side locking projection 40 is claw-like and coupled to the lower surface of the laterally protruding part of the corresponding rail 39, as shown in FIG. 15. Each housing side locking projection 40 is lockable to a detector side locking projection 68 of the detector 11.

As shown in FIGS. 10 to 13, the detector 11 includes a fitting 45 and the detecting body 42. The fitting 45 includes an insertion space 46 inside. The detector 11 is movable in the front-rear direction with respect to the housing 10 to a standby position where the housing body 13 is inserted shallowly in the insertion space 46, as shown in FIG. 3, and to a detection position where the housing body 13 is inserted deeply in the insertion space 46 as shown in FIG. 5.

Figure 11:
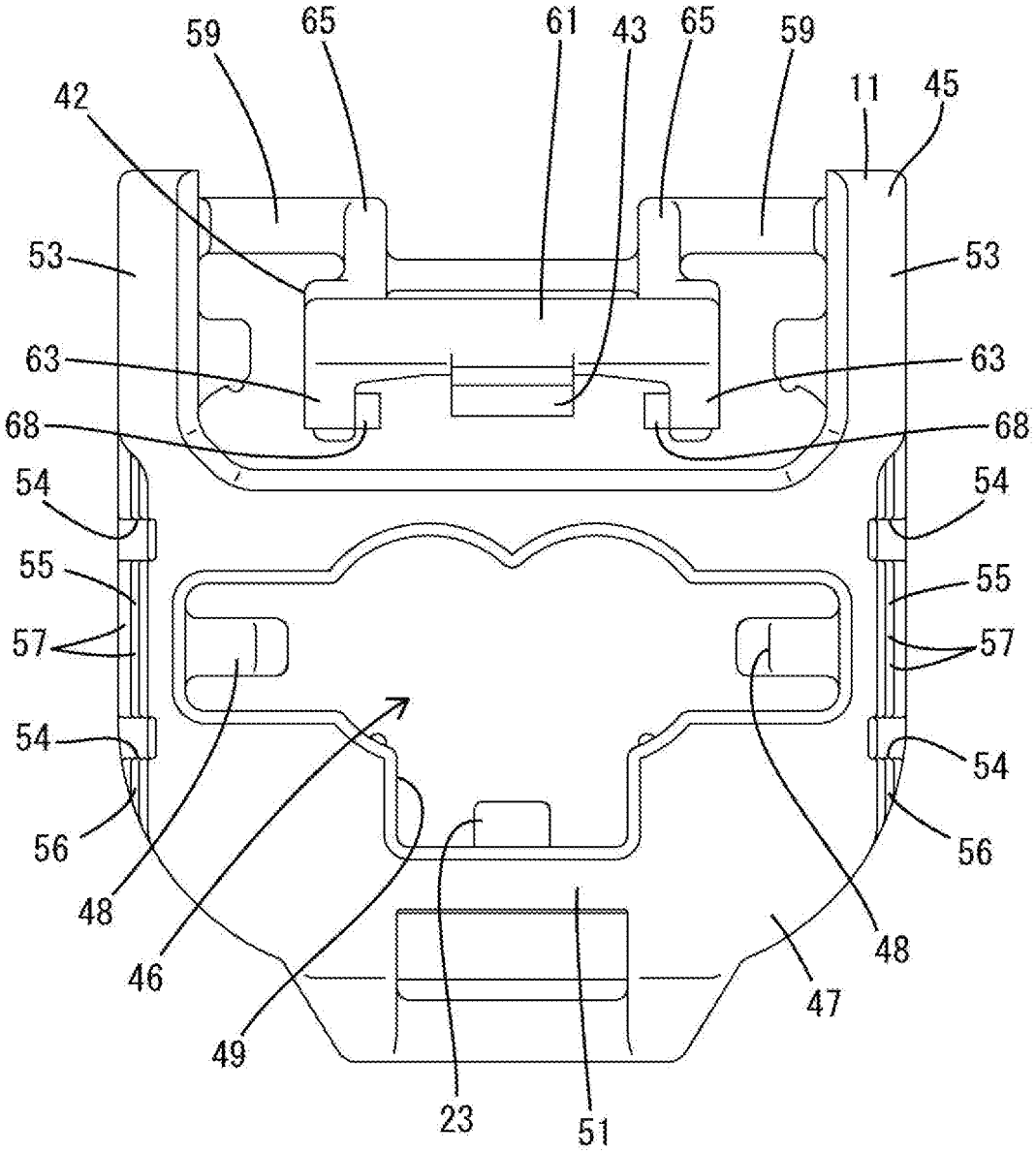
FIG. 11 is a back view of the detector.

As shown in FIG. 11, the fitting 45 includes a back wall 47 for closing a rear side of the insertion space 46. A central part of the back wall 47 includes a wide through hole 49 that makes interfering portions 48 and the locking claw 23 visually confirmable. At the detection position, the respective tubular portions 21 of the housing body 13 are fit in the through hole 49 of the back wall 47 and the back wall 47 surrounds the entire peripheries of the tubular portions 21.

Figure 12:
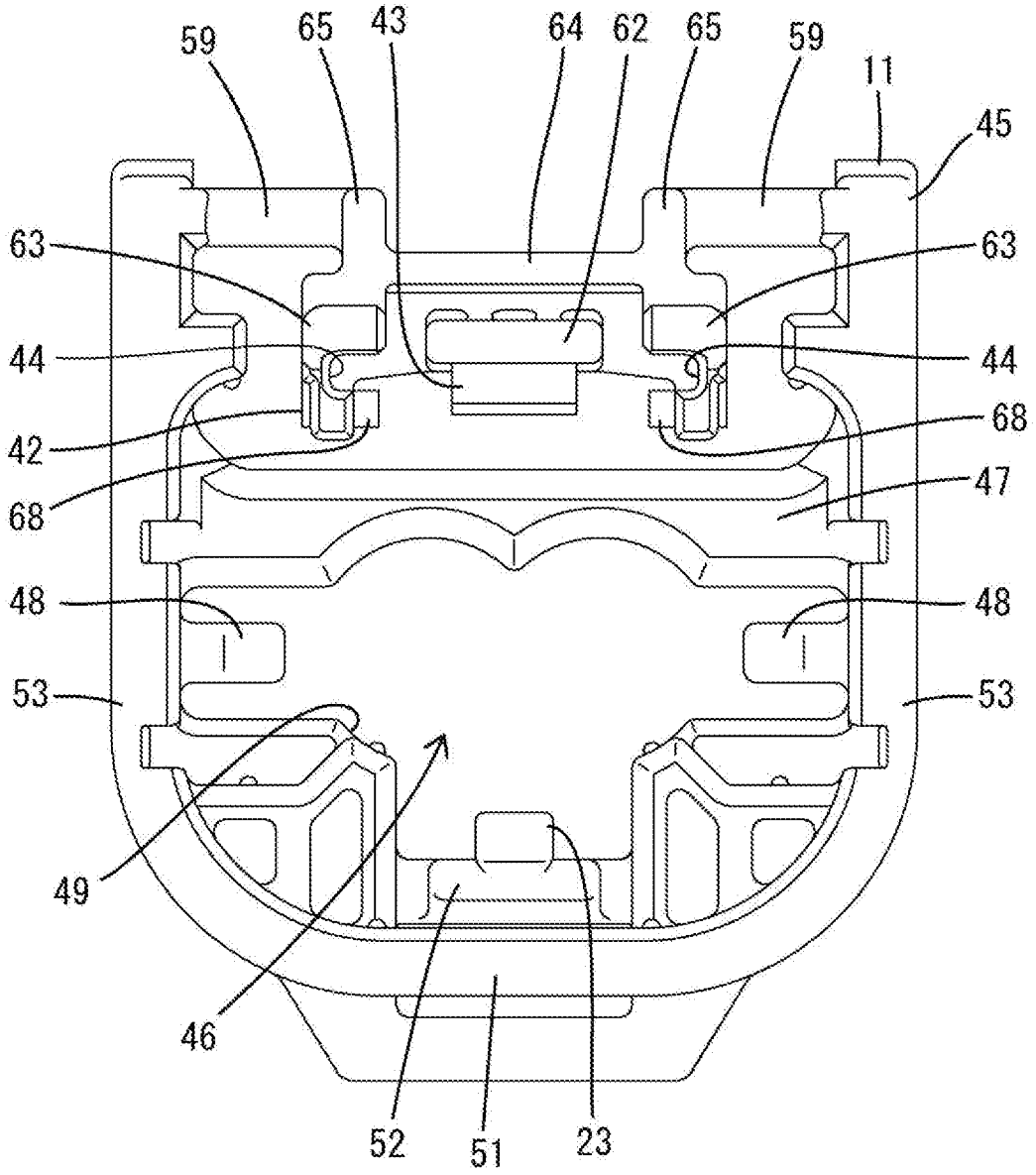
FIG. 12 is a front view of the detector.

As shown in FIG. 12, the fitting 45 has a lower wall 51 for closing a lower side of the insertion space 46, and a deflectable retaining arm 52 projects forward in a widthwise center of a rear part of the lower wall 51. As shown in FIG. 3, a locking claw 23 projects up on a front part of the retaining arm 52. The locking claw 23 is locked to the retaining protrusion 22 of the housing 10 after the retaining arm 52 is deflected.

Figure 7:
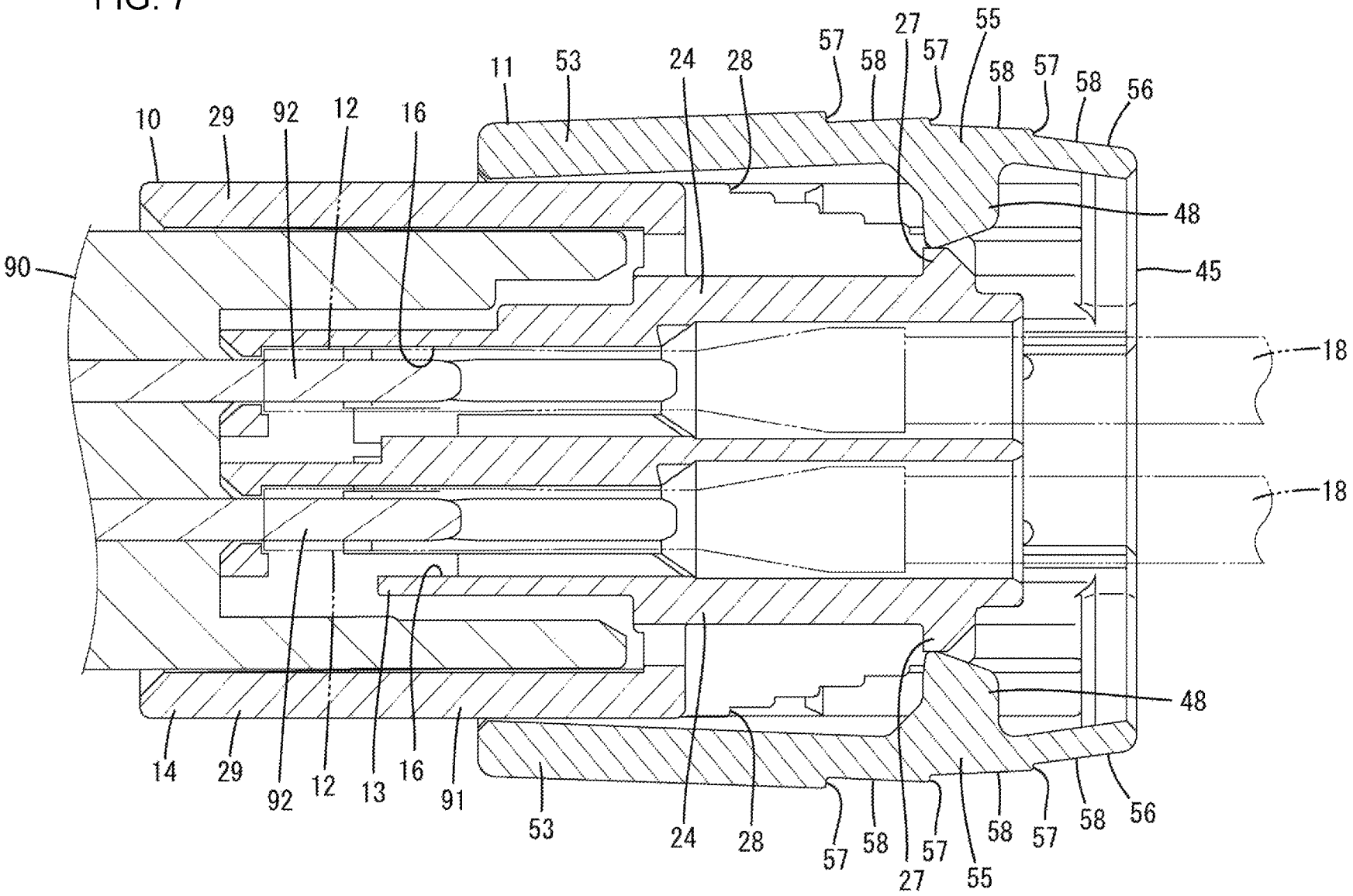
FIG. 7 is a section showing a state where the interfering portions ride on the protrusions and the resilient pieces are bulging out in the process of properly connecting the housing to the mating housing and moving the detector toward the detection position.
Figure 8:
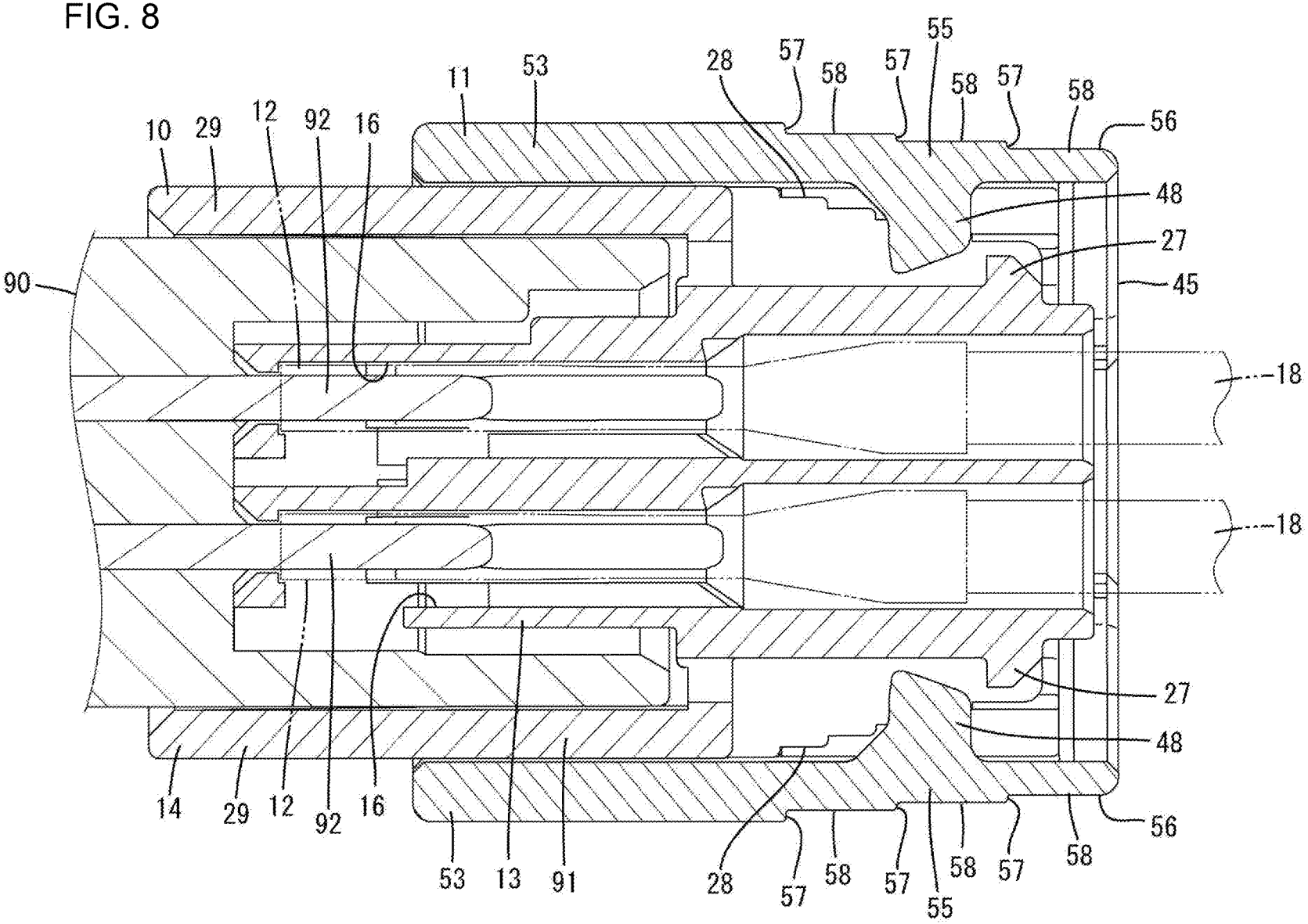
FIG. 8 is a section showing a state where the detector has moved to the detection position and the interfering portions and the protrusions are spaced from each other in a front-rear direction.
Figure 10:
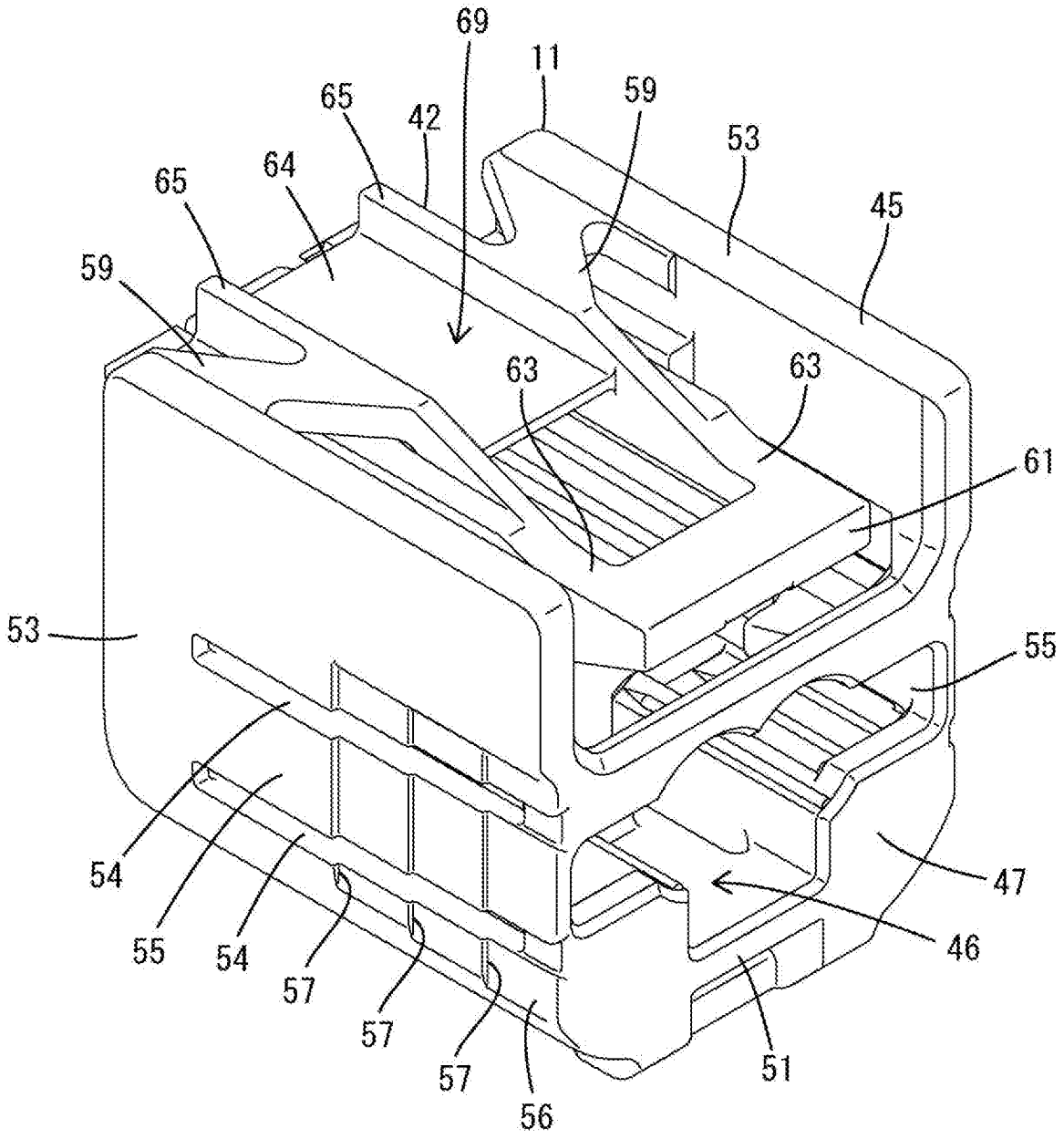
FIG. 10 is a perspective view of the detector.

As shown in FIG. 12, side walls 53 are on both widthwise ends of the fitting 45 for closing both widthwise sides of the insertion space 46 on. As shown in FIG. 10, each side wall 53 includes upper and lower slits 54 extending long in the front-rear direction and a strip-like resilient piece 55 between the upper and lower slits 54. Each resilient piece 55 is in the form of a beam supported on both ends and is deflectable with parts coupled to front and rear end parts of the corresponding side wall 53 as supports. As shown in FIGS. 6 to 8, each resilient piece 55 includes the claw-like interfering portion 48 projecting on a rear part of an inner surface. A projecting part of the rear surface of the interfering portion 48 is tapered and inclined forward and the front surface of the interfering portion 48 is arranged along the width direction. The interfering portion 48 can interfere with the protrusion 27 of the housing 10 and has larger thickness in the front-rear direction and projecting dimension than the protrusion 27.

As shown in FIG. 10, a rear part of each side wall 53 has a recessed surface 56 recessed inwardly from front, upper and lower parts (peripheral area). A rear part of each resilient piece 55 is provided in each recessed surface 56. The recessed surfaces 56 have stepped shapes so that a width interval (widths of the respective side walls 53) becomes gradually smaller from front ends toward rear ends. Specifically, as shown in FIGS. 6 to 8, each recessed surface 56 is constituted by alternately disposing rearward facing surfaces 57 extending short in the width direction and arranged to face rearward and laterally facing surfaces 58 extending along the front-rear direction and arranged to face laterally in the front-rear direction. The rearward facing surfaces 57 and the laterally facing surfaces 58 are arranged continuously over the entire height of the recessed surface 56 via the upper and lower slits 54, as shown in FIG. 10.

Each rearward facing surface 57 is formed along a line extending in the vertical direction in a side view. Further, the respective rearward facing surfaces 57 are formed to be successively located more outward toward a front end. as shown in FIG. 11. The inner surface of each side wall 53 is flat in the front-rear direction except at the interfering portion 48, as shown in FIGS. 6 to 8. Thus, each side wall 53 becomes gradually thinner toward a rear except at the interfering portion 48 in the recessed surface 56.

Figure 13:
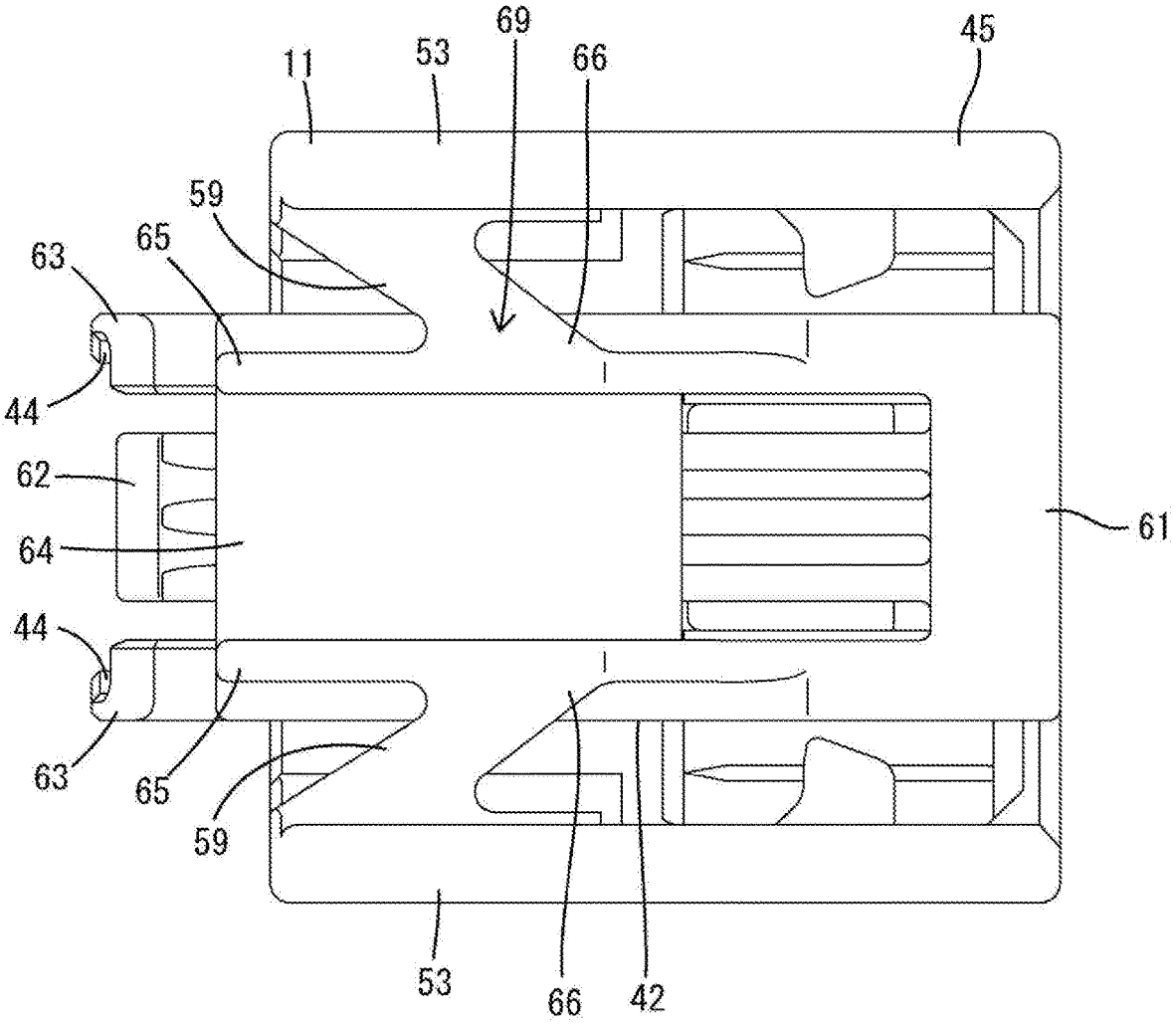
FIG. 13 is a plan view of the detector.

As shown in FIG. 13, the detecting body 42 is a plate extending in the front-rear direction between upper ends of the side walls 53. Further, the detector 11 includes two coupling portions 59 bridged between side surfaces on both widthwise sides of the detecting body 42 and the side walls 53.

The detecting body 42 is slidable in the front-rear direction with respect to the lock arm 15 while being inserted in the assembly space 37 of the lock arm 15, and is tiltable together with the arm body 36 with the respective coupling portions 59 as supports.

The detecting body 42 includes a base 61 extending in the width direction in a rear end part, a resilient arm 62 projecting forward from a widthwise central part of the base 61, two guide arms 63 projecting forward from both widthwise ends of the base 61, and a plate-like cover 64 bridged between the respective guide arms 63 and arranged to straddle over the resilient arm 62. A front part of the detecting body 42 projects farther forward than the front end of the fitting 45.

Figure 1:
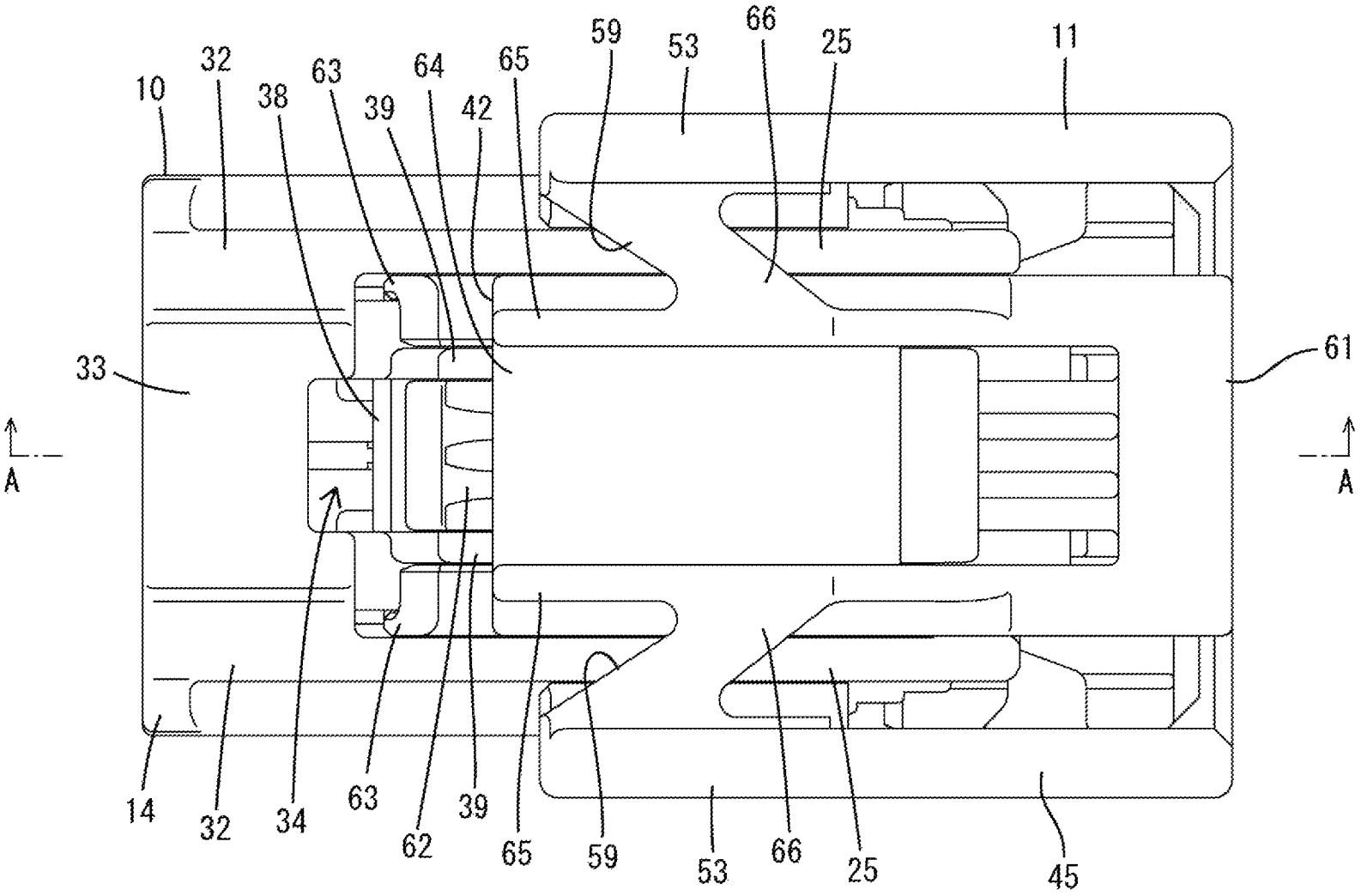
FIG. 1 is a plan view of a connector of one embodiment of the invention showing a state where a detector is held at a standby position with respect to a housing.

The resilient arm 62 and the respective guide arms 63 are parallel to each other. When the detecting body 42 is inserted into the assembly space 37 of the lock arm 15, upward protruding parts of the respective rails 39 are fit into spaces between the resilient arm 62 and the respective guide arms 63 as shown in FIG. 1 and the plate-like portion 41 is fit into a space between the resilient arm 62 and the cover 64, as shown in FIG. 3.

The guide arms 63 include two rail grooves 44 extending in the front-rear direction in the inner surfaces thereof, as shown in FIG. 12. The guide arms 63 are mounted on the lock arm 15 to embrace the respective rails 39 from outside with the laterally protruding parts (see FIG. 15) of the respective rails 39 fit in the respective rail grooves 44.

The guide arms 63 include ribs 65 extending in the front-rear direction while projecting up. As shown in FIG. 3, a rear part of the upper surface of each rib 65 is inclined down toward a rear end.

The guide arms 63 include detector side locking projections 68 projecting toward each other on inner sides. The detector side locking projections 68 are arranged on lower surfaces of the corresponding rail grooves 44. When the detector 11 is at the standby position, the detector side locking projections 68 are lockable to the corresponding housing side locking projections 40.

The claw-like detector lock 43 projects down on a front part of the resilient arm 62. The detector lock 43 contacts the rear surface of the housing lock 38 at the standby position to restrict a movement of the detector 11 to the detection position as shown in FIG. 3, and is in contact with the front surface of the housing lock 38 at the detection position to restrict a movement of the detector 11 in a return direction to the standby position, as shown in FIG. 5.

As shown in FIG. 10, the cover 64 has both widthwise sides coupled to lower parts of the inner surfaces of the ribs 65 and the flat upper surface thereof is located slightly below the upper surfaces of the ribs 65. As shown in FIG. 13, the rear end of the cover 64 is spaced apart from the base 61.

As shown in FIG. 13, each coupling 59 is a tapered strip plate extending oblique to the width direction and the front-rear direction from a front end part of the inner surface of each side wall 53 to a substantially central part in the front-rear direction of an upper part of the outer surface of each rib 65 (side surface of the detecting body 42). The upper surface of each coupling 59 is substantially continuous and flush with the upper surface of each rib 65 without any step. The front end of each coupling 59 is at substantially the same position as the front end of each side wall 53 (also the front end of the fitting 45). The coupling 59, the side wall 53 and the rib 65 form substantially a Z-shape in a plan view.

A tilting fulcrum 66 is defined where a rear end of each coupling 59 is connected to the corresponding rib 65 of the detecting body 42 and is twisted and deformed resiliently when the detecting body 42 is tilted. The tilting fulcrum 66 of each coupling 59 is at a position in the front-rear direction overlapping the corresponding leg 35 that serves as a tilting fulcrum of the lock arm 15 and is substantially at the same position as the corresponding leg 35 in the front-rear direction at the standby position.

The fitting 45 includes an opening 69 that opens upward between the upper ends of the respective side walls 53. As shown in FIG. 13, the detecting body 42 is exposed to the opening 69 and can be confirmed visually from above through the opening 69.

Next, how to connect/separate the housings 10, 90 is described.

Figure 17:
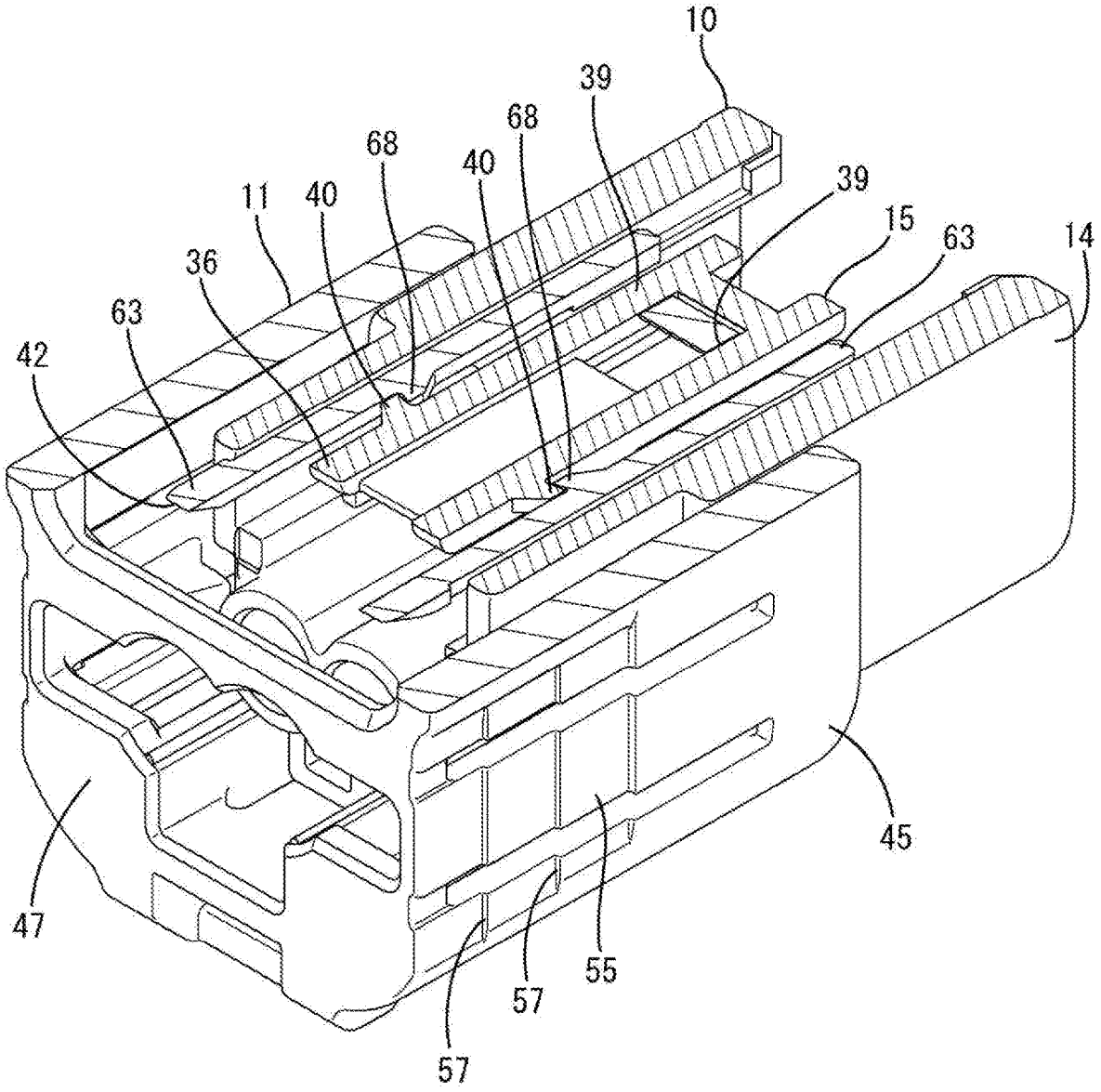
FIG. 17 is a perspective view partly in section showing a state where detector side locking projections are locked to housing side locking projections to restrict the rearward escape of the detector when the detector is at the standby position.

First, the detector 11 is assembled with the housing 10. The assembling of the detector 11 at the standby position is guided by fitting the respective rails 39 of the lock arm 15 into the rail grooves 44 of the respective guide arms 63 and fitting the rear part of the housing body 13 into the insertion space 46. At the standby position, the locking claw 23 of the retaining arm 52 is in contact with the front surface of the retaining protrusion 22 to be lockable to this front surface, as shown in FIG. 3, and the respective detector side locking projections 68 are in contact with the front surfaces of the respective housing side locking projections 40 to be lockable to these front surfaces, as shown in FIG. 17. In this way, the detector 11 is retained on both upper and lower sides with respect to the housing 10 and the rearward escape is restricted reliably. Further, the detector lock 43 of the detecting body 42 is in contact with and lockable to the rear surface of the housing lock 38 of the lock arm 15 to restrict a forward movement of the detector 11 toward the detection position.

Further, at the standby position, a clearance (part of the open space 34 of FIG. 1) is formed between the cover 64 and the bridge 33, as shown in FIG. 1, and a front part of the resilient arm 62 is exposed in this clearance to be visually confirmable. Furthermore, at the standby position, the interfering portions 48 of the respective resilient pieces 55 are arranged to face and to contact projecting inclined parts of the rear surfaces of the respective protrusions 27 from behind, as shown in FIG. 6.

The housing 10 then is connected to the mating housing 90. In the process of connecting the housings 10, 90, the housing lock 38 of the arm body 36 rides on the lock 93, and the arm body 36 is tilted in a seesaw manner in the vertical direction with the legs 35 as supports, as shown in FIG. 4. At this time, the detecting body 42 also tilts with the arm body 36 with the respective couplings 59 as supports. Since the tilting fulcrums 66 of the respective couplings 59 and the respective legs 35 are arranged at the same position in the front-rear direction, a tilting displacement of the lock arm 15 and that of the arm body 36 are synchronized satisfactorily substantially without interfering with each other.

When the housings 10, 90 are connected properly, the arm body 36 resiliently returns to an initial substantially horizontal state and the lock 93 is in contact with the rear surface of the housing locking portion 38 to be lockable to this rear surface. On the other hand, the detector locking portion 43 is pushed up by the lock 93 and unlocked from the housing locking portion 38. In this way, a movement of the detector 11 from the standby position to the detection position in front of the standby position is allowed. Further, when the housings 10, 90 are connected properly, the respective mating terminal fittings 92 are inserted to a proper depth into the connecting portions 19 of the respective terminal fittings 12 to be connected electrically.

Figure 9:
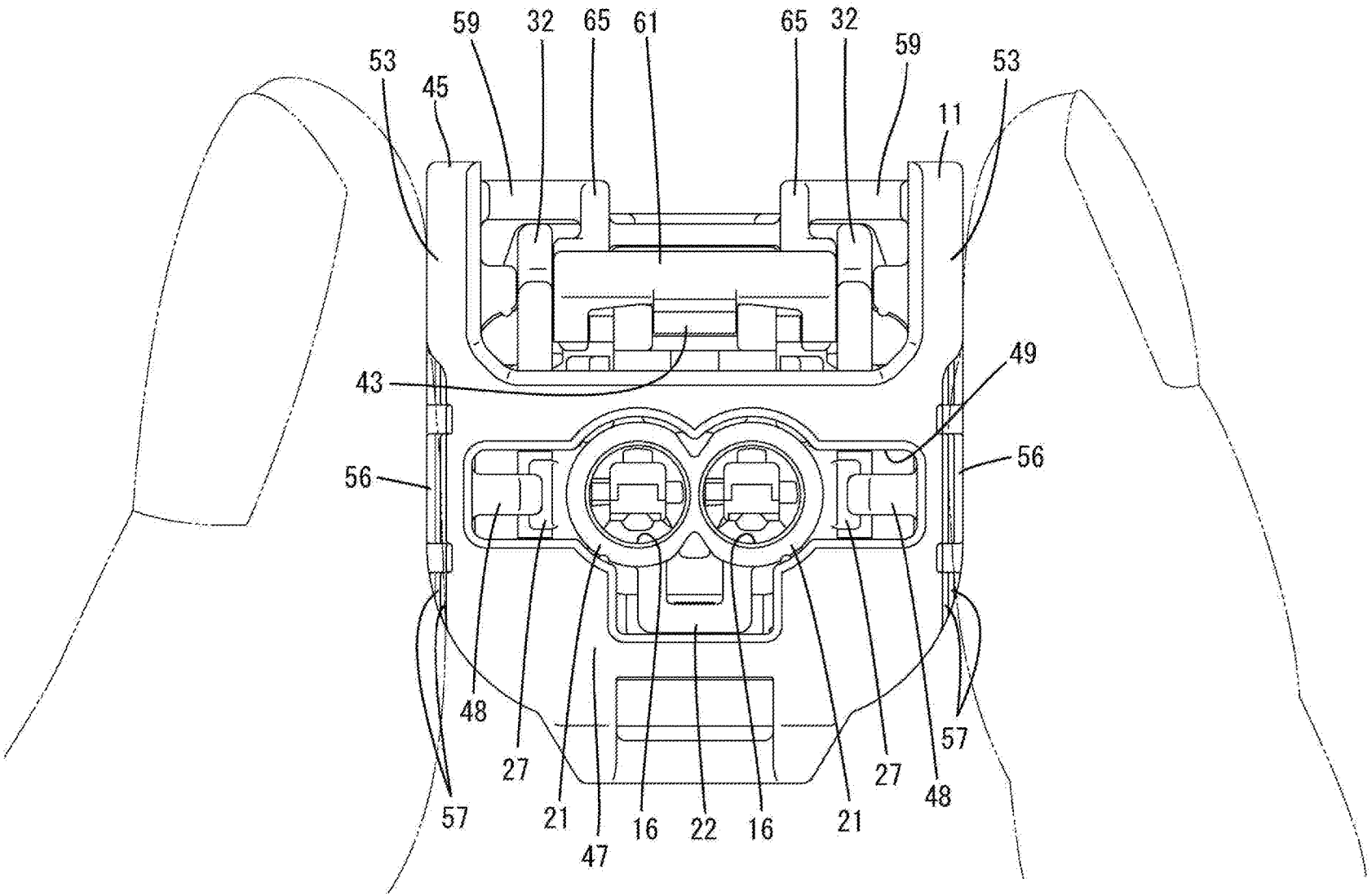
FIG. 9 is a back view showing the state where the detector is held at the standby position with respect to the housing.

Subsequently, the detector 11 is moved to the detection position while being gripped by fingers, as shown in FIG. 9. A worker can move the detector 11 toward the detection position by placing the fingers in contact with the respective side walls 53 of the fitting 45 of the detector 11 and pushing the detector 11 forward. The side walls 53 include the recessed surfaces 56 and the respective rearward facing surfaces 57 of the recessed surfaces 56 are provided in plural rows to extend in the front-rear direction while facing rearward. Thus, the worker can select the respective rearward facing surfaces 57 as operating areas. Then, the worker presses the detector 11 forward while placing the fingers in contact with the respective rearward facing surfaces 57, thereby being able to move the detector 11 toward the detection position without slipping the fingers on the recessed surfaces 56.

In the process of moving the detector 11 to the detection position, the interfering portions 48 of the respective resilient pieces 55 contact with and ride on the respective protrusions 27 and the respective resilient pieces 55 are deflected and deformed to bulge out from the recessed surfaces 56, as shown in FIG. 7. At this time, the worker can touch the bulging resilient pieces 55 (in particular, the rearward facing surfaces 57 and the laterally facing surfaces 58 of the resilient pieces 55) while his fingers are pushed by the resilient pieces 55, and the fingers can feel the bulge of each resilient piece 55. Further, in the process of moving the detector 11 to the detection position, the detector locking portion 43 slides on the upper surface of the housing locking portion 38, and the resilient arm 62 is deflected and deformed with a rear end side near the base 61 as a support.

Figure 2:
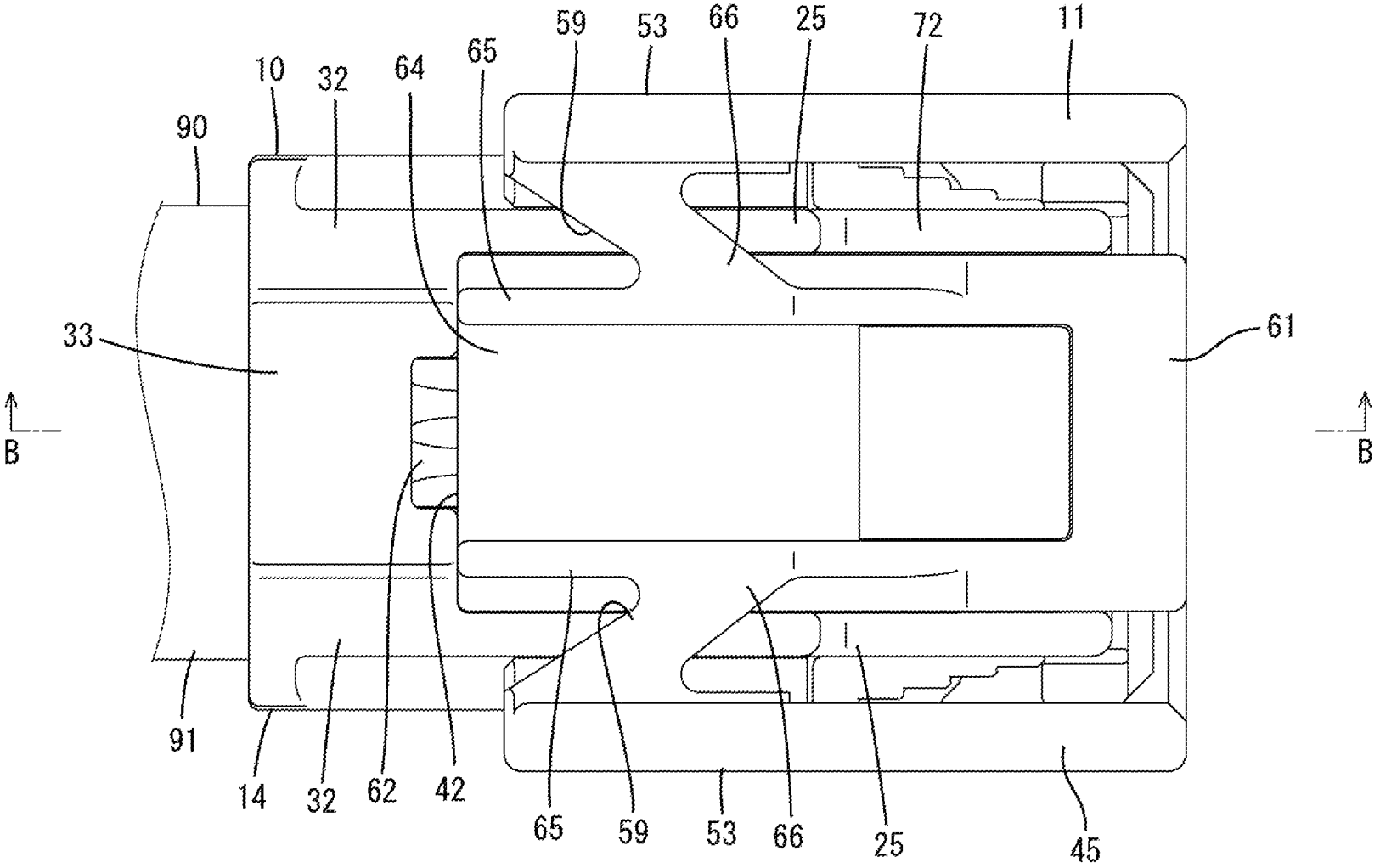
FIG. 2 is a plan view showing the housing connected properly to a mating housing and the detector moved to a detection position with respect to the housing.

Immediately before the detector 11 reaches the detection position, the interfering portions 48 of the resilient pieces 55 ride over the protrusions 27 and the resilient pieces 55 resiliently return to eliminate the bulge. As the resilient pieces 55 resiliently return, the detector 11 arrives at the detection position at once and the resilient arm 62 also resiliently returns. Thus, the detector locking portion 43 is in contact with the front surface of the housing locking portion 38 to be lockable to this front surface, as shown in FIG. 3. In this way, a movement of the detector 11 in the return direction to the standby position is restricted. Further, since the front end of the cover 64 is arranged to contact the bridge 33, as shown in FIG. 2, and the back wall 47 of the fitting 45 is arranged to contact the rear part of the housing body 13, a forward movement of the detector 11 beyond the detection position is restricted. A front part of the resilient arm 62 is hidden inside the bridge 33 and cannot be seen from above. Further, when the detector 11 is at the detection position, the interfering portions 48 of the resilient pieces 55 are separated forward from the protrusions 27 and not in contact with the protrusions 27, as shown in FIG. 8.

If the housings 10, 90 are not connected properly and the lock 93 is not locked to the housing locking portion 38, the detector locking portion 43 is kept locked to the housing locking portion 38. Thus, the detector 11 cannot be moved from the standby position to the detection position. Therefore, it can be judged that the housings 10, 90 are connected properly if the detector 11 can be moved toward the detection position and the housings 10, 90 are not connected properly unless the detector 11 can be moved to the detection position.

That the detector 11 at the detection position can be detected by visually confirming a moving state of the detector 11 with respect to the housing 10, for example, by visually confirming a state where the front end of the cover 64 is in contact with the bridge 33 as shown in FIG. 2. Further, a movement of the detector 11 to the detection position also can be sensed by an operation feeling when the resilient arm 62 resiliently returns.

The presence of the detector 11 at the detection position also can be detected tactually by fingers of a worker. Specifically, the worker moves the detector 11 to the detection position while placing his or her fingers in contact with the rearward facing surfaces 57 on the outer sides of the resilient pieces 55 and also on areas of the side walls 53 near the resilient pieces 55 and adjacent the upper and lower slits 54. Thus, the fingers can confirm the existence and the elimination of the bulge of each resilient piece 55.

On the other hand, the housings 10, 90 are separated from each other for maintenance or the like by inserting fingertips into the opening 69 of the fitting 45 and pushing a rear end side (base 61 and the like) of the detecting body 42 down by the fingertips. The detecting body 42 then is tilted together with the arm body 36, and the lock arm 15 and the lock 93 are unlocked from each other. If the detector 11 is pressed rearward in that state, the housings 10, 90 gradually move in separating directions and the detector 11 also moves in the return direction to the standby position. The locking claw 23 of the retaining arm 52 then is locked to the retaining protrusion 22 to keep the detector 11 at the standby position with respect to the housing 10, and the housings 10, 90 are pulled apart.

As described above, the detector 11 can be moved smoothly from the standby position to the detection position by gripping the rearward facing surfaces 57 in the recesses 56 of the side walls 53 by fingers and pushing the rearward facing surfaces 57 forward after the housings 10, 90 are connected properly. The resilient pieces 55 align with the rearward facing surfaces 57. Thus, the fingers are pushed by the resilient pieces 55 when the resilient pieces 55 bulge out in the process of moving the detector 11 to the detection position, and the bulging of each resilient piece 55 can be felt by the fingers. Further, the bulge of each resilient piece 55 is eliminated when the detector 11 moves to the detection position and that state also can be felt by the fingers. Thus, a movement of the detector 11 to the detection position can be sensed tactually in addition to visual confirmation and operation feeling. As a result, the detector 11 can be moved reliably to the detection position.

The interfering portions 48 of the resilient pieces 55 are separated forward from the respective protrusions 27 and do not contact the protrusions 27 when the detector 11 is at the detection position. Thus, there is no need to consider positional relationships and shapes of the interfering portions 48 and the protrusions 27, and a degree of freedom in arrangements and shapes of the interfering portions 48 and the protrusions 27 can be enhanced.

The worker can have a good tactile sense since the fingers are pushed by the respective resilient pieces 55 bulging from the recessed surfaces 56. Further, since the respective rearward facing surfaces 57 do not project laterally from the side walls 53, a concern about interference with a moving operation of the detector 11 can be reduced.

Other embodiments are briefly described below.

The detector may include the side wall at least on one side across the detecting body.

The resilient piece, the interfering portion and the protrusion may be provided on only one of the side walls.

The rearward facing surfaces may be provided only on the resilient pieces and not in areas of the side surfaces of the side walls adjacent to the slits.

The rearward facing surfaces may be provided only in areas of the side surfaces of the side walls adjacent to the resilient pieces via the slits without being on the resilient pieces.

The rearward facing surfaces may be slopes inclined with respect to the width and the front-rear directions. Thus, the laterally facing surfaces can be omitted from the recesses.

The outer surfaces of the resilient pieces may be recessed slightly inward with respect to the outer surfaces of the areas of the recessed surfaces adjacent to the resilient pieces via the upper and lower slits. According to this configuration, in moving the detector to the detection position, worker's fingers do not constantly touch the outer surfaces of the resilient pieces and can touch the resilient pieces only when the interfering portions interfere with the protrusions and the resilient pieces bulge outward.

LIST OF REFERENCE SIGNS

10 . . . housing
11 . . . detector
15 . . . lock arm
27 . . . protrusion
38 . . . housing locking portion
42 . . . detecting body
43 . . . detector locking portion
45 . . . fitting
48 . . . interfering portion
53 . . . side wall
54 . . . slit
55 . . . resilient piece
56 . . . recessed surface
57 . . . rearward facing surface
59 . . . coupling
66 . . . tilting fulcrum
69 . . . opening
90 . . . mating housing
93 . . . lock

What is claimed is:

1. A connector, comprising:

a housing connectable to a mating housing; and a detector movable on the housing in a front-rear direction, the detector being allowed to move from a standby position to a detection position in front of the standby position when the housing is connected properly to the mating housing; wherein:

the housing includes a protrusion on a side surface;

the detector includes a side wall configured to cover the side surface of the housing;

the side wall includes an exterior surface facing outward on the detector, a resilient piece exposed on the exterior surface of the side wall, the resilient piece having an inwardly facing surface facing toward the housing and toward the protrusion, the inwardly facing surface of the resilient piece having an interfering portion configured to interfere with the protrusion when moving the detector to the detection position, interference of the interfering portion with the protrusion causing the resilient piece to bulge out when moving the detector to the detection position, and the interfering portion being arranged apart from the protrusion in the front-rear direction when the detector is at the detection position to eliminate bulge at the detection position; and the exterior surface of the side wall further includes a rearward facing surface arranged to face rearward at position adjacent to the resilient piece via slits formed on both sides of the resilient piece, the rearward facing surface is provided in a recessed surface that is recessed with respect to a peripheral area of the resilient piece on the side wall.

2. The connector of claim 1, wherein the side wall of the detector has a plurality of rearward facing surfaces on each side of the resilient piece.

3. The connector of claim 1, wherein the detector has two opposite side walls, each of the side walls having one of the resilient pieces and a plurality of the rearward facing surfaces on each side of the respective resilient piece.

4. The connector of claim 1, wherein the side wall of the detector has a plurality of rearward facing surfaces spaced from one another in a front to rear direction on the detector, and the rearward facing surfaces being arranged in a stepped manner so that the rearward facing surfaces project farther out at more forward positions on the side wall.

5. A connector, comprising:

a housing connectable to a mating housing; and a detector movable on the housing in a front-rear direction, the detector being allowed to move from a standby position to a detection position in front of the standby position when the housing is connected properly to the mating housing; wherein:

the housing includes a protrusion on a side surface;

the detector includes a side wall configured to cover the side surface of the housing;

the side wall includes a resilient piece configured to bulge out by interfering with the protrusion in a moving process to the detection position and eliminate bulge at the detection position;

a side surface of the side wall includes a rearward facing surface arranged to face rearward at a position adjacent to the resilient piece via slits formed on both sides of the resilient piece; and the rearward facing surface is provided in a recessed surface that is recessed with respect to a peripheral area of the resilient piece on the side wall.

6. A connector, comprising:

a housing connectable to a mating housing; and a detector movable on the housing, the detector being allowed to move from a standby position to a detection position in front of the standby position when the housing is connected properly to the mating housing; wherein:

the housing includes a protrusion on a side surface;

the detector includes a side wall configured to cover the side surface of the housing;

the side wall includes a resilient piece configured to bulge outward by interfering with the protrusion when moving to the detection position and to eliminate bulge at the detection position; and a side surface of the resilient piece includes a rearward facing surface facing rearward; and the rearward facing surface is provided in a recessed surface that is recessed with respect to a peripheral area of the resilient piece on the side wall.

7. The connector of claim 6, wherein of the resilient piece has an interfering portion configured to interfere with the protrusion, the interfering portion being arranged apart from the protrusion in the front-rear direction when the detector is at the detection position.

* * * * *